US006652184B1

(12) United States Patent
Knafelc et al.

(10) Patent No.: US 6,652,184 B1
(45) Date of Patent: Nov. 25, 2003

(54) APPARATUS FOR ROADWAYS AND THE LIKE

(76) Inventors: Keith Knafelc, Box 23, Engelfeld, Saskatchewan (CA), S0K 1N0; Lloyd Knafelc, Box 23, Engelfeld, Saskatchewan (CA), S0K 1N0

( * ) Notice: Subject to any disclaimer, the term of this patent is extended or adjusted under 35 U.S.C. 154(b) by 0 days.

(21) Appl. No.: 09/886,837

(22) Filed: Jun. 21, 2001

(30) Foreign Application Priority Data

Jun. 27, 2000 (CA) ..... 2312527

(51) Int. Cl.[7] ..... E01C 5/00
(52) U.S. Cl. ..... 404/41; 404/35; 404/40
(58) Field of Search ..... 404/18, 28, 29, 404/32, 33, 34, 35, 36, 37, 38, 39, 40, 41, 44

(56) References Cited

U.S. PATENT DOCUMENTS

| | | | | | |
|---|---|---|---|---|---|
| 432,245 | A | * | 7/1890 | Meigs | 52/302.1 |
| 1,574,729 | A | * | 2/1926 | Foster | 404/35 |
| 1,622,104 | A | * | 3/1927 | Fulton | 404/35 |
| 2,017,185 | A | * | 10/1935 | Rockwell | 52/284 |
| 2,031,596 | A | * | 2/1936 | Fulbright | 52/578 |
| 2,094,571 | A | * | 9/1937 | Fischer | 404/35 |
| 2,227,878 | A | * | 1/1941 | Crooks | 52/578 |
| 2,377,211 | A | * | 5/1945 | Cocken, Jr. | 404/38 |
| 3,377,931 | A | * | 4/1968 | Hilton | 404/35 |
| 3,579,941 | A | * | 5/1971 | Tibbals | 52/384 |
| 3,707,820 | A | * | 1/1973 | Leandri | 52/272 |
| 4,095,913 | A | * | 6/1978 | Pettersson et al. | 217/96 |
| 4,152,875 | A | * | 5/1979 | Soland | 404/35 |
| 4,376,596 | A | * | 3/1983 | Green | 404/35 |
| 4,711,599 | A | * | 12/1987 | Glickman | 404/41 |
| 4,826,351 | A | * | 5/1989 | Haberhauer et al. | 404/35 |
| 5,046,887 | A | * | 9/1991 | Fontana et al. | 404/34 |
| 5,098,218 | A | * | 3/1992 | Reese et al. | 404/35 |
| 5,160,215 | A | * | 11/1992 | Jensen | 404/35 |
| 5,335,473 | A | * | 8/1994 | Chase | 52/533 |
| 5,366,224 | A | * | 11/1994 | Stanwyck et al. | 404/35 |
| 5,466,089 | A | * | 11/1995 | Jurik | 404/34 |
| 5,484,230 | A | * | 1/1996 | Rudloff | 404/35 |
| 5,906,454 | A | * | 5/1999 | Medico, Jr. et al. | 404/32 |
| 6,055,784 | A | * | 5/2000 | Geiger | 404/38 |
| 6,145,261 | A | * | 11/2000 | Godfrey et al. | 52/302.1 |
| 6,182,413 | B1 | * | 2/2001 | Magnusson | 52/309.8 |
| 6,237,295 | B1 | * | 5/2001 | Ballard | 52/391 |
| 6,418,686 | B1 | * | 7/2002 | Record | 52/284 |
| 2001/0015042 | A1 | * | 8/2001 | Ballard | 52/589.1 |
| 2002/0050114 | A1 | * | 5/2002 | Friso | 52/782.1 |
| 2002/0083673 | A1 | * | 7/2002 | Kettler et al. | 52/578 |

FOREIGN PATENT DOCUMENTS

| | | | | | |
|---|---|---|---|---|---|
| GB | 2091775 | A | * | 1/1981 | E04C/1/00 |
| GB | 2184143 | A | * | 12/1986 | E01C/5/00 |
| GB | 2199864 | A | * | 1/1988 | E01C/5/00 |

* cited by examiner

*Primary Examiner*—Thomas B. Will
*Assistant Examiner*—Alexander K. Pechhold
(74) *Attorney, Agent, or Firm*—Patterson, Thuente, Skaar & Christensen, P.A.

(57) ABSTRACT

An apparatus to provide a temporary road way with minimal damage to the ground surface beneath the apparatus comprises a plurality of adjacent sections held together by a retainer. Each section comprises a front and back face. The front face of a section mates with the back face of an adjacent section to form an interface at a non-perpendicular angle to the direction of travel. An interlock is also provided whereby each section provides vertical support to each adjacent section.

4 Claims, 7 Drawing Sheets

T
15A
15B
6
8
9
N
N
14
2C
7
6
9D
9C
9B
9A
9
2B
2A
7

T
15A
15B
6
8
2
2
2
2
2
2
7
6
9D
9C
9B
9A
7

APPARATUS FOR ROADWAYS AND THE LIKE

This invention is in the field of temporary or portable roadways, and in particular such roadways that are suitable for use in sensitive environments and soft ground.

BACKGROUND

It is often required for construction, exploration, and like purposes to construct roadways through rough territory including soft ground. These roadways are often temporary and in the interests of preserving the environment, it is desired to have a roadway wherein heavy equipment can enter an area to do a job as required and leave the area with as little damage to the ground surface as possible.

The military, emergency measures organizations and the like also have occasion to move equipment quickly into areas where no roads are available. Temporary air strips must sometimes be made under adverse conditions as well as roadways.

Also in soft ground vehicles get stuck and are unable to proceed until pulled by a tractor or the like, and even then they may not be able to proceed. The tractor further damages the ground, making ruts and so forth.

Corduroy roads, wherein logs and so forth are laid lengthwise across the path of the road have been used in the past to cross soft areas of ground. Improvements to the well known corduroy road have also been known, for example as disclosed in U.S. Pat. No. 5,282,692 to McLeod. The McLeod patent discloses a series of parallel members joined together and extending substantial perpendicular to the path of the roadway.

A problem with such prior art apparatuses for roadways is that the members are substantially perpendicular to the path of vehicles travelling on the roadway with the result that the wheels of the vehicles pass suddenly and directly from one lateral member to the next, causing significant impact loading. The weight of a vehicle on each member, combined with the impact loading, also causes the same to sink somewhat relative to the next adjacent member where no weight is present, and as the wheel rolls, it must climb up onto the next adjacent member to progress down the roadway, decreasing the efficiency of the vehicle. This effect also causes the wheels of the vehicle to push against the members of the roadway, putting added stress on the links holding one member to the next.

SUMMARY OF THE INVENTION

It is an object of the present invention to provide an apparatus that can be laid on the ground, including soft ground, as a roadway to facilitate travel by vehicles over the apparatus.

It is a further object of the present invention to provide such an apparatus that reduces damage caused to the ground surface by the vehicles.

It is a further object of the present invention to provide such an apparatus that enables a temporary roadway to be hauled to a site and quickly assembled for use.

The present invention addresses these objectives by providing a flexible roadway with advantages over apparatuses currently employed in the art. The apparatus comprises a number of sections held adjacent to each other by a retainer. Each of these sections comprises a top surface, a bottom surface, a front face and a back face. The front face of a section mates with the back face on an adjacent section to form an interface. The interface of the mating faces is at a non-perpendicular angle to the direction of travel substantially along its length.

This invention addresses the problem created by prior art roadways, which consist of members substantially perpendicular to the path of the vehicle, where the weight of the wheel passing over the sections causes an impact load on each section in turn. In the present design, the interface between adjacent sections is not perpendicular to the path of the vehicle so that the weight of the vehicle is applied gradually to each adjacent section rather than suddenly loading it. While even a minor deviance from the perpendicular will effect some reduction in impact loading, the greater the angle the more gradual the weight transfer. For practical design purposes, it is anticipated that an angle between 40 and 50 degrees will be most suitable for most applications.

The reduction in impact loading will reduce the amount each member sinks in relation to the adjacent members.

The present invention may further include a system to interlock a section to adjacent sections. The back face of one section may contain a groove that interlocks with a corresponding tongue contained in the front face of the adjacent section. Thus downward force on one section will exert a downward force on the adjacent sections, thereby increasing the area of the ground surface the force is being applied to, and further reducing the amount each section sinks.

The apparatus may also include hollow vertical tubes passing through the sections. These tubes brace the top surface of each section, reduce damage to the ground beneath the roadway by releasing pressure built up under the sections, and provide somewhat improved traction for the vehicle wheels on the surface of the apparatus.

Where the apparatus is made from a hollow formed plastic, the apparatus could be made light enough to be easily moved and quickly placed in position.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
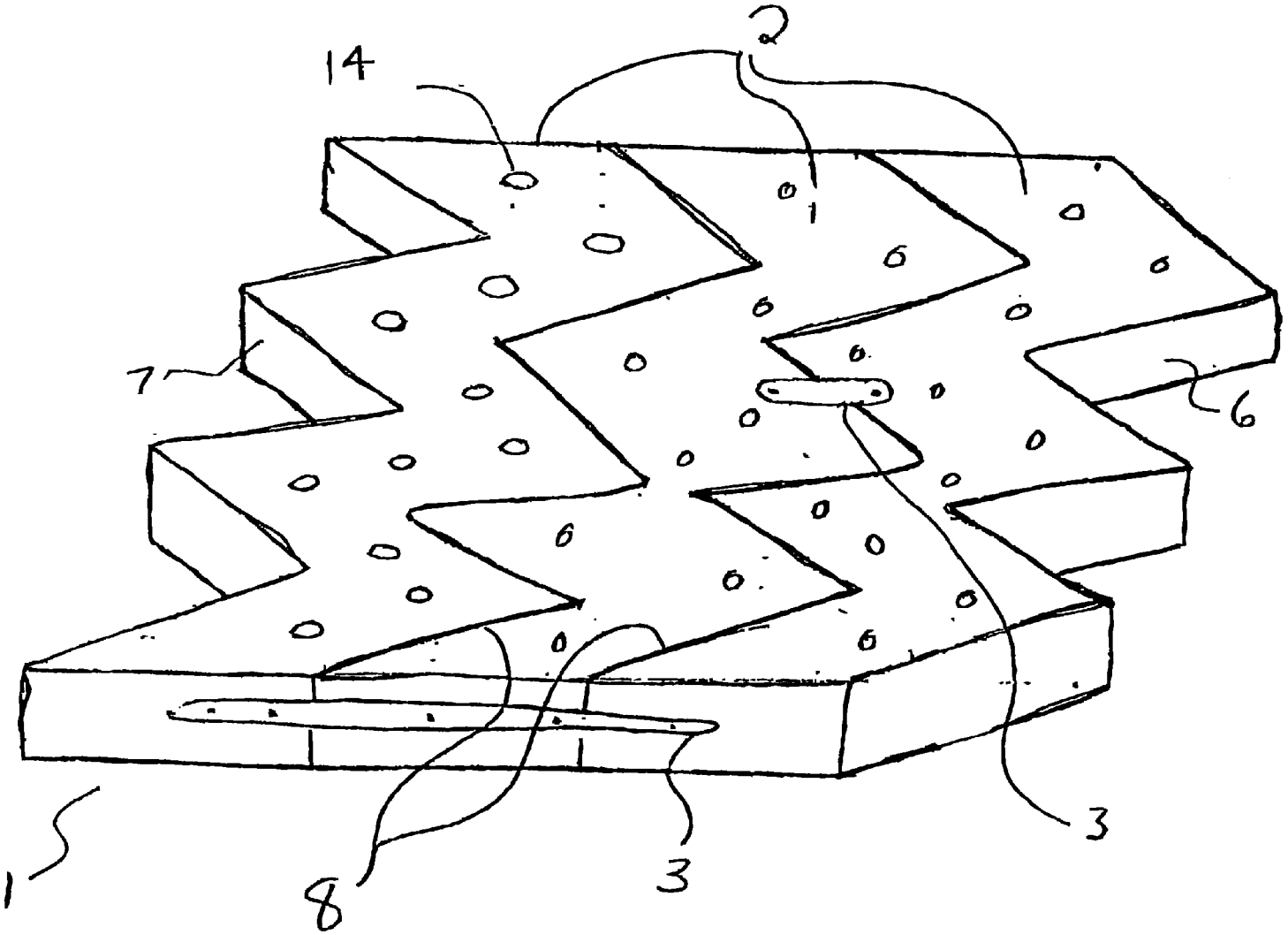
FIG. 1 is a perspective view of an embodiment of the invention.

FIG. 1 shows an apparatus 1 for providing a roadway for the passage of vehicles there-over in a direction of travel. The apparatus comprises a plurality of sections 2 held together by a retainer 3. The illustrated retainers 3 are longitudinal members which can be screwed or otherwise conventionally attached to the tops, bottoms or ends of the sections 2 to hold them together.

Figure 2:
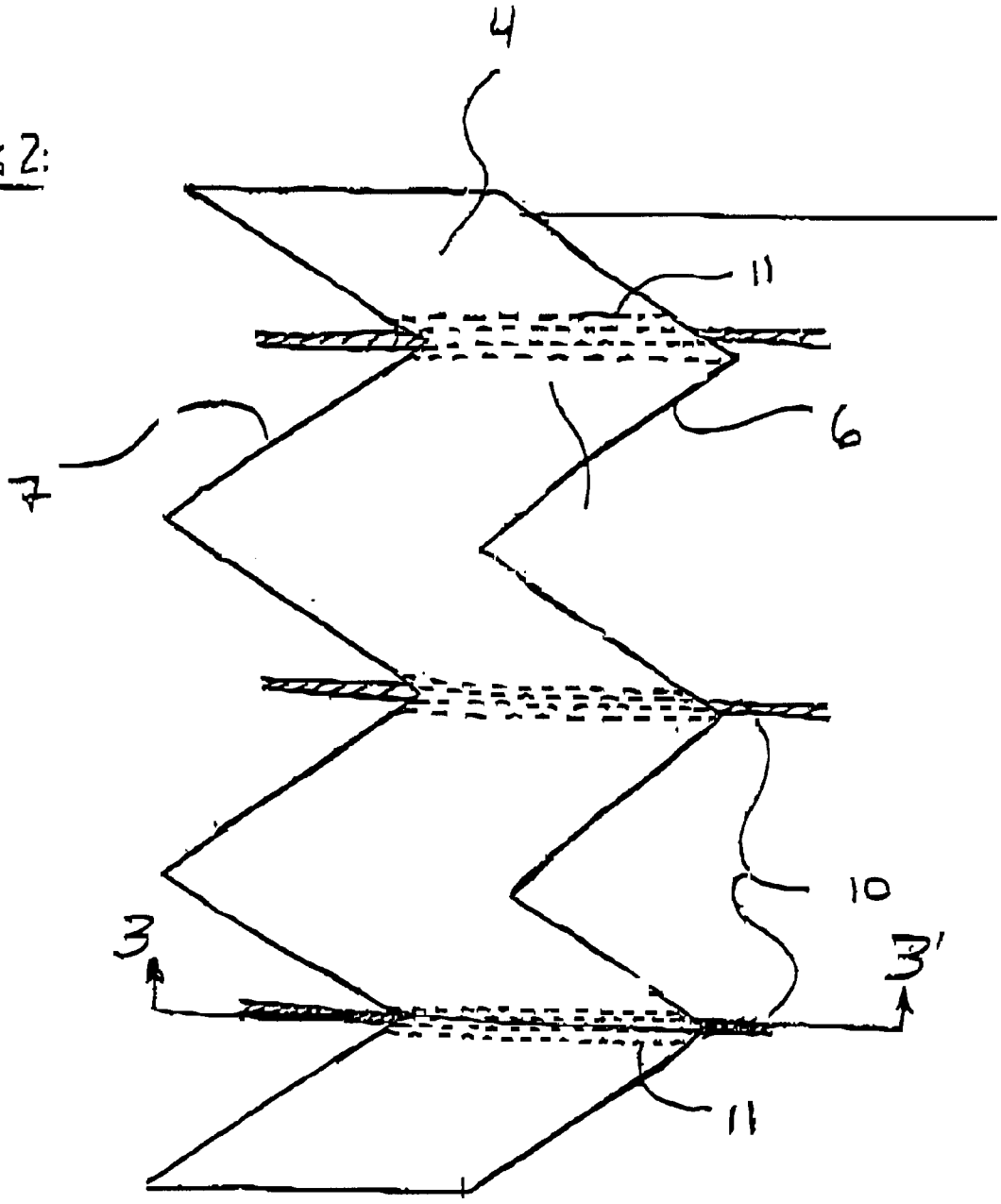
FIG. 2 is a top view of an individual section.
Figure 3:
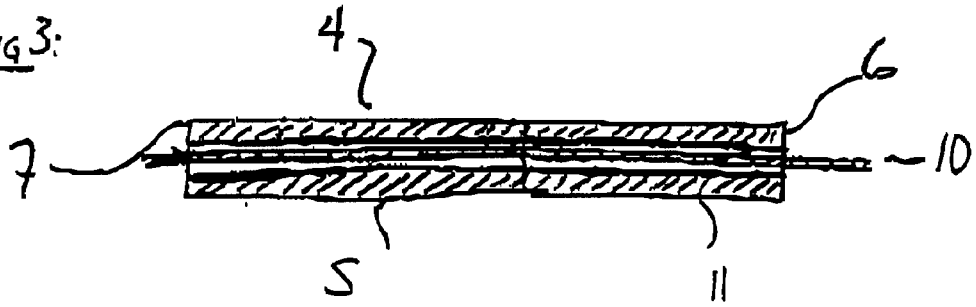
FIG. 3 is a cross-section along 3—3 in FIG. 2.

FIGS. 2 and 3 show a top and side view, respectively, of an individual section 2. Each of these sections 2 comprise a top surface 4, a bottom surface 5, a front face 6 extending between the top surface 4 and the bottom surface 5 from one end of the section to an opposite end thereof and a back face 7 extending between the top surface 4 and the bottom surface 5 from one end of the section to an opposite end thereof.

FIGS. 2 and 3 also show an individual section 2 where the retainer 3 comprises cables 10. The cables 10 pass through the front face 6, then pass between the top surface 4 and the bottom surface 5 and then through the back face 7 of each section. The cables 10 in this embodiment pass through by means of a hollow tube 11 that accommodates the cable 10. The cables 10 provide a fast, easily connected retainer for several sections at once.

Figure 4:
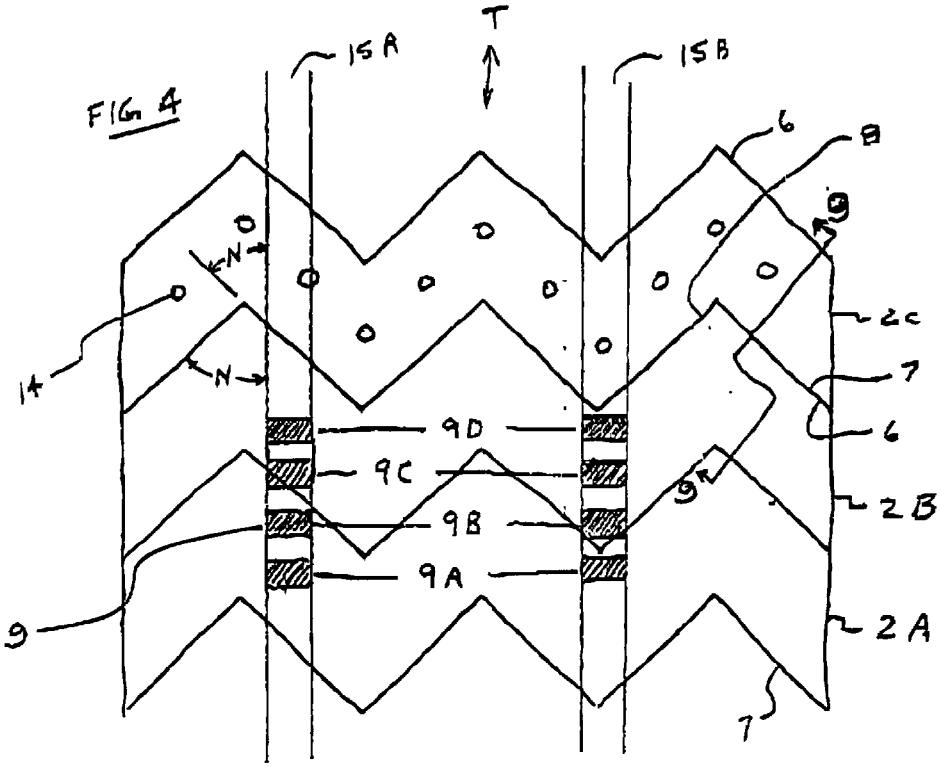
FIG. 4 is a top view of three individual sections of an apparatus showing the contact patches of a pair of vehicle wheels.
Figure 5:
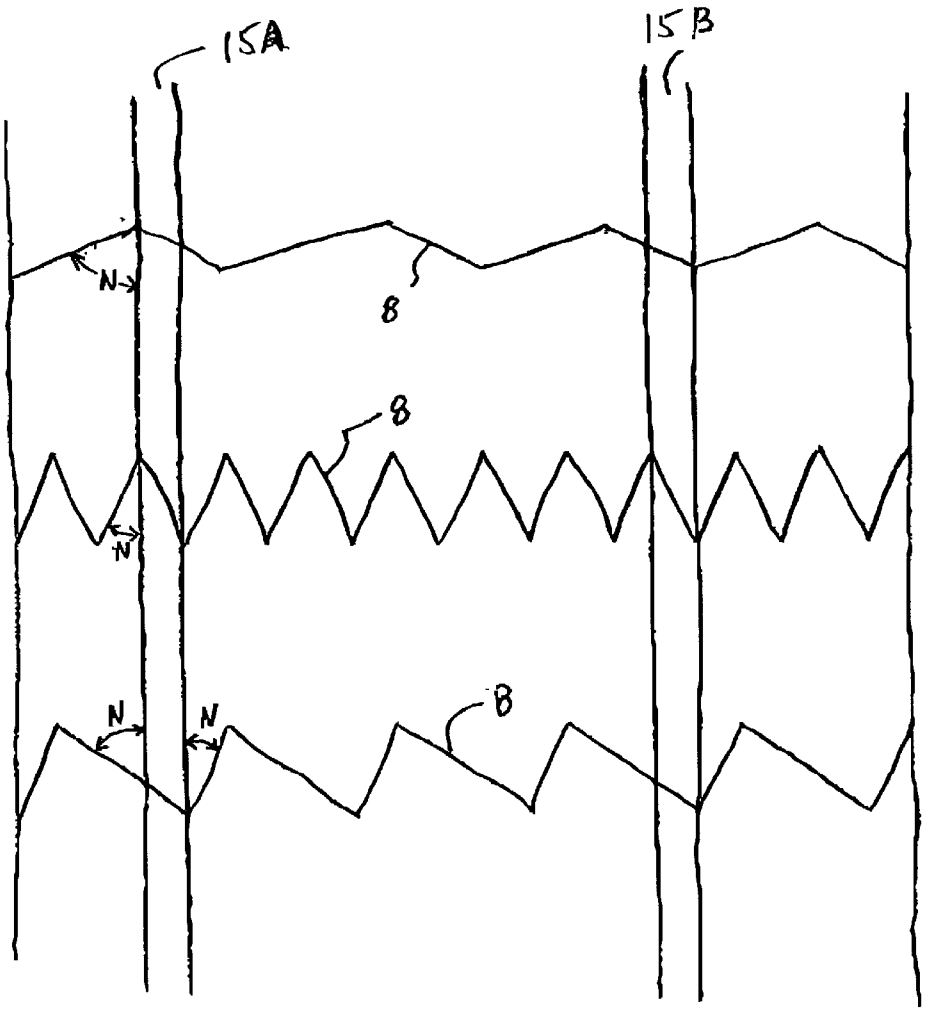
FIG. 5 is a top view of an apparatus with alternate angles to the path of travel.

FIG. 4 shows three adjacent sections 2A, 2B and 2C of an apparatus. Any number of sections may be fastened together to form an apparatus of the desired length. The front face 6 of one section and the back face 7 of an adjacent section substantially mate to form an interface 8. This interface 8 is at an angle N that is at 45 degrees to the angle of travel along the majority of its length. The angle N could alternately be that shown on one of the interfaces 8 as illustrated in FIG. 5. While any deviance from the perpendicular will effect some reduction in impact loading, the greater the angle the more gradual the weight transfer.

The result of an interface 8 as in FIG. 4 or 5 is that the weight of the vehicle is gradually transferred from one section to an adjacent section.

Figure 7:
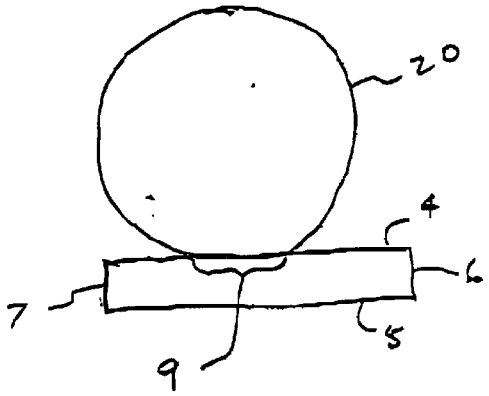
PRIOR ART FIG. 7
FIG. 7 is a side view of a wheel on the apparatus.
Figure 8:
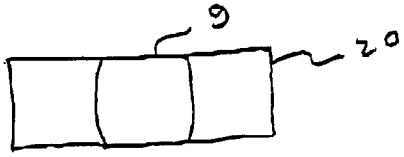
FIG. 8 is a bottom view of a vehicle wheel showing the contact patch which exerts downward force on the apparatus as the vehicle moves along the apparatus.

The embodiment illustrated in FIG. 4 shows an angle of 45 degrees from the perpendicular, which is achieved by the illustrated zig-zag pattern of the interface 8 across the width of the roadway. Two wheel paths 15A and 15B extend along the direction of travel indicated by the double-headed arrow T. It will be understood that vehicles can of course pass in either direction along the apparatus as indicated by T. The contact patch 9 of a wheel 20 is as illustrated in FIGS. 7 and 8. The contact patches 9 of a pair of wheels on a vehicle axle traveling along the apparatus on the wheel paths 15A, 15B is shown in four locations 9A, 9B, 9C and 9D in FIG. 4.

Because of the zig-zag orientation of the interface, it is unlikely that the contact patches 9 of both wheels will come in contact with the adjacent section at the same time. This will have the result that the time over which the load is applied fully to the section will be further extended. When the contact patch 9 approaches the next adjacent section at position 9A, the load created by the vehicle will be substantially on the first section 2A. As the wheel progresses in direction T the contact patch 9 of one wheel will move further onto the adjacent section and the contact patch 9 of the other wheel will begin to move onto the adjacent section 2B. As the wheel progresses in direction T it will continue to move onto the adjacent section, until the entire contact patch of one wheel is on the adjacent section 2B as in position 9C. This causes the load the wheels exert on the apparatus 1 to be transitionally transferred to the adjacent section 2B from 2A, rather than suddenly.

As the wheels continue progressing forward, the contact patches 9 move on to the next section 2B causing more and more force to be applied to the next section 2B until both contact patches 9 are on the adjacent section in position 9D. When this occurs, the weight of the vehicle has been substantially transferred to the adjacent section 2B. The result of this is the weight being applied to the adjacent section starts at approximately zero and increases to approximately the full weight over some extended amount of time. Both wheels are on one section for less time compared to a perpendicular interface as well, since in position 9D where both wheels are on section 2B, the wheel in path 15B is very near the next interface 8 where weight will be again transferred to the next section 2C.

Figure 4A:
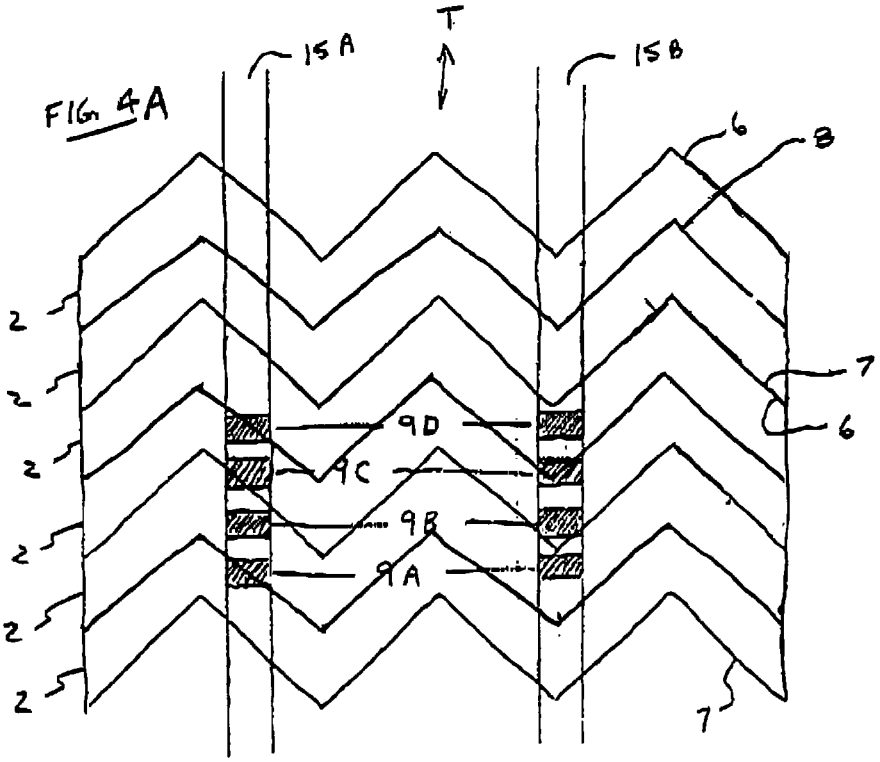
FIG. 4A is a top view of an apparatus similar to that illustrated in FIG. 4 but where the sections are one half as big, there being six individual sections, showing the contact patches of the pair of vehicle wheels of FIG. 4.
Figure 6:
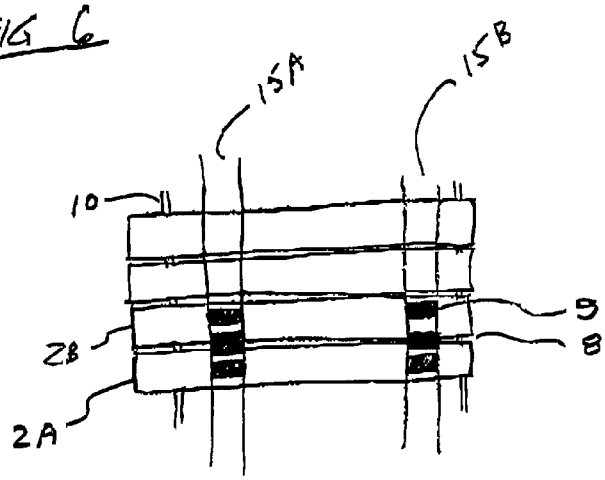
FIG. 6 is a top view of a prior art roadway apparatus.
Figure 6A:
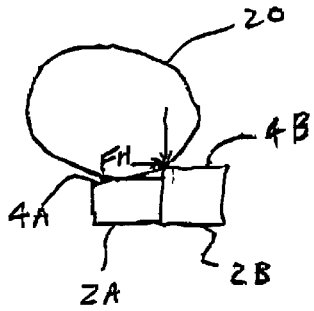
PRIOR ART FIG 6A
FIG. 6A is a side view of the prior art showing a wheel moving from one section to the next.

FIG. 4A illustrates how the effect is accentuated in an embodiment where the sections 2 are one half as big as those of FIG. 4, such that six sections 2 occupy the same length of wheel paths 15A, 15B that is occupied by three sections in FIG. 4. In FIG. 4A the contact position patches 9A–9D show that at no position are both wheels wholly located on one section. The relative size of the sections 2 can be varied to accommodate the wheels that will be used thereon.

Where the interface 8 of adjacent sections is perpendicular substantially along its length to the direction of travel as in the prior art illustrated in FIG. 6, the contact patch 9 crossing the interface 8 would cause the next section to be impact loaded. The load on the section increases from zero or no load to the full load applied by the wheel almost instantaneously. This impact loading causes each section in turn to be driven farther into the ground surface beneath the apparatus. The apparatus 1 reduces the impact loading and thereby reduces the effect of the traffic on the surface under the apparatus.

Impact loading each adjacent section causes it to be driven into the ground surface beneath the apparatus 1, which is a negative impact on the environment. As a result of the section the wheel is presently on 2A being driven into the ground, the top surface 4B of the next adjacent section 2B is now above the top surface 4A of section 2A, the vehicle has to climb up to continue down the roadway. This causes further damage to the underlying ground surface, increases the effort needed for the vehicle to progress down the roadway and stresses the retainer, such as cables 10 illustrated, used to keep the sections adjacent to each other. The cables 10 are stressed directly by the horizontal component of force FH exerted on the adjacent section while the wheel climbs onto the top 4B. Reducing the impact load will reduce these detrimental effects.

Figure 9:
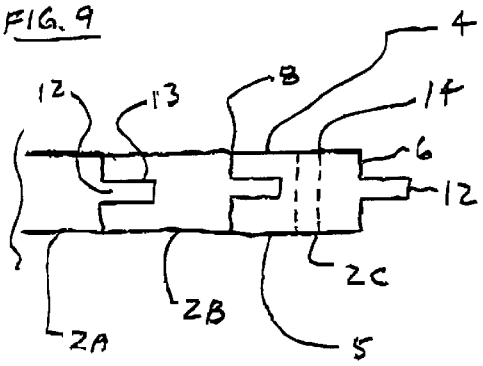
FIG. 9 is a cross-section along 9—9 in FIG. 4 showing a tongue and groove interlock system.

FIG. 9 shows an embodiment of the apparatus 1 where adjacent sections interlock by means of a tongue 12 and groove 13. A tongue 12 is mounted on one of the faces of the section. A corresponding groove 13 is defied by the mating face of the adjacent section.

The interlocking allows the load on one section to be transferred to adjacent sections even before the contact patch 9 of the wheel comes in contact with the adjacent section. As weight on a section 2 tends to push it down, the tongue 12 and groove 13 on of the front and rear face of the section 2 transfer force to the adjacent sections on both sides, supporting the loaded section. The bottom surface area of the apparatus 1 through which the load is being applied to the ground surface is thus increased, with a corresponding reduction in sinking, and a reduction in the stress on the ground.

The apparatus can include hollow tubes 14 running vertically through the sections 2 as illustrated in FIGS. 1, 4 and 9. The hollow tubes 14 extend from the top surface 4 to the bottom surface 5 and are open at both surfaces of the section 2. Vehicles passing over the apparatus 1 cause pressure to build up underneath. Water and soil or mud underneath the apparatus 1 can cause this built up pressure to be blocked from escaping. If the pressure is great enough this mud blocking the pressure from escaping is displaced out from under the apparatus 1 so the pressure can escape and thereby damages the ground surface. Placing tubes 14 running through the sections of the apparatus 1 results in this pressure being able to escape without displacing some of the mud underneath the apparatus 1 and therefore reduces the effect of the apparatus 1 on the ground surface.

Figure 14:
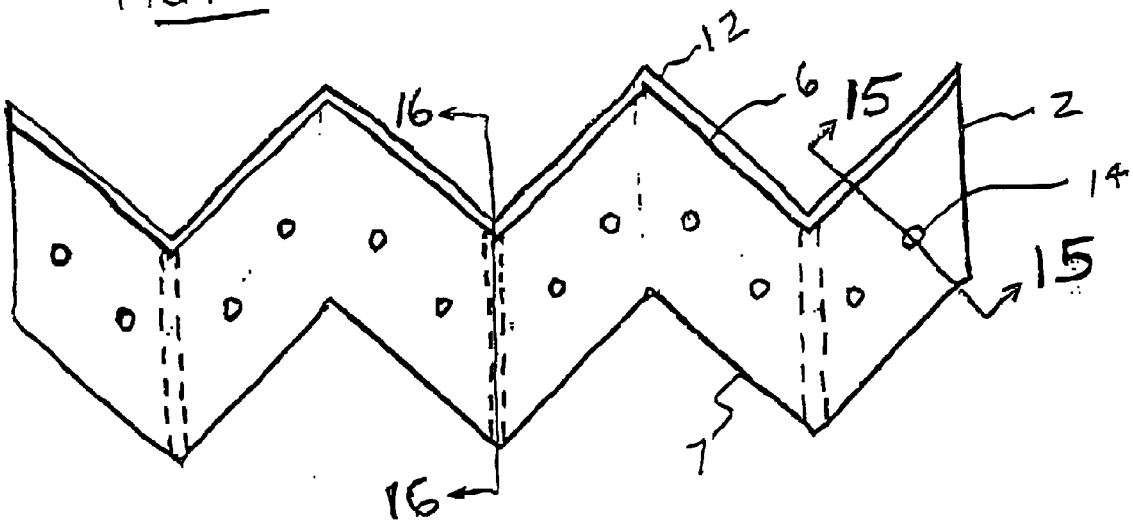
FIG. 14 is a top view of a section of an embodiment of the invention.
Figure 15:
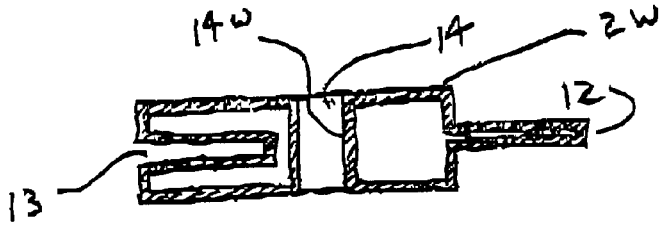
FIG. 15 is a cross-section along 15—15 in FIG. 14.
Figure 16:
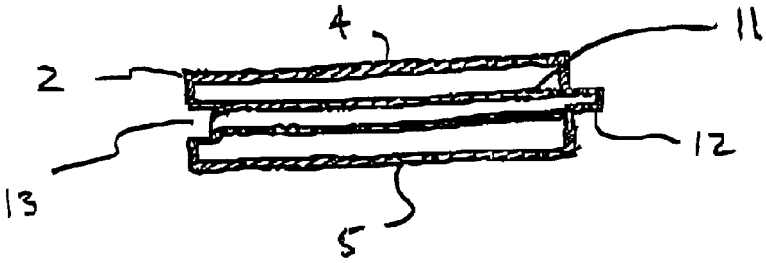
FIG. 16 is a cross-section along 16—16 in FIG. 14.

The hollow tubes 14 also add support to the apparatus 1 by serving as a brace. While the sections can be made of any material, a typical embodiment of the invention is illustrated in FIGS. 14–16 showing a hollow section 2 formed from roto-molded plastic to reduce weight. The section wall 2*w* may be much thinner, and the section thus lighter, where the vertical walls 14*w* of the tubes 14 support the upper surface 4 of the section 2. Where the sections are molded, the tubes 14 could be tapered towards the mid-point to facilitate removal from a mold.

Hollow plastic sections could be made to have sufficient buoyancy to support a load and could then be used as floats where desired. It is contemplated that an apparatus of the invention made from hollow sections could be used as a floating bridge in some conditions.

The tubes 14 also break up the top surface 4 so that it is not as slick as a smooth unbroken surface, providing somewhat increased traction for vehicles passing over it. The surface can also be roughened or textured to improve traction, or where molded, the mold could include a textured surface.

In FIG. 15, the tongue 12 is illustrated as projecting almost half way across the width of the section. FIG. 16 illustrates a shorter tongue 12.

Figure 10:
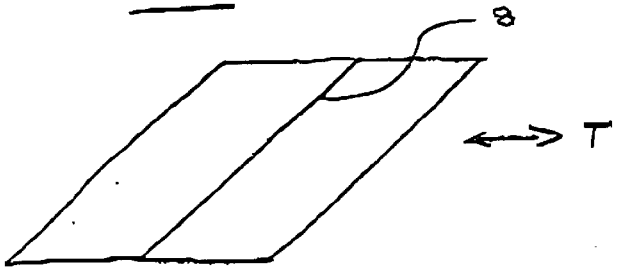
FIGS. 10–13 are top views showing several alternate interfaces of the apparatus.
Figure 11:
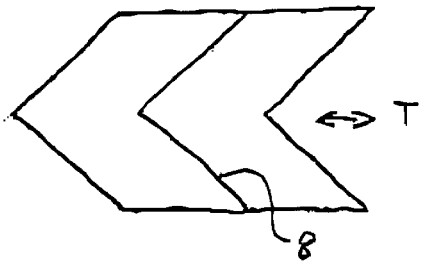
Figure 12:
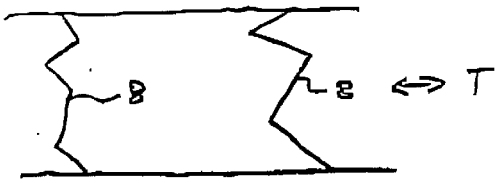
Figure 13:
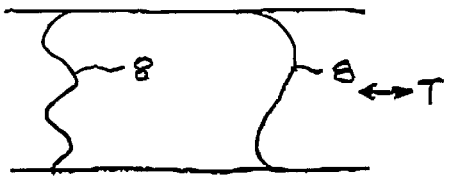

FIG. 10 shows another embodiment of the apparatus where the interface 8 is straight and at approximately forty five degrees from the direction of travel. FIG. 11 shows another embodiment of the apparatus where the angle of the interface 8 from the direction of travel alternates from approximately plus forty five degrees to approximately negative forty five degrees. FIG. 12 shows an alternate embodiment of the apparatus where the interface 8 is an uneven zig-zag pattern. FIG. 13 shows another embodiment of the apparatus where the interface 8 is a wave pattern. Practical considerations regarding ease of manufacturing and so forth will dictate the most economical pattern for a given application.

The apparatus can be used to provide roadways, walkways, airstrips, landing pads for helicopters, or the like.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. An apparatus for providing a roadway for the passage of vehicles there-over in a direction of travel, the apparatus comprising:

a plurality of sections held together by a retainer, each section comprising:

a top surface;

a bottom surface;

a front face extending between the top surface and the bottom surface from one end of the section to an opposite end thereof;

a back face extending between the top surface and the bottom surface from one end of the section to an opposite end thereof; and a plurality of hollow tubes, each hollow tube extending from the top surface of the section to the bottom surface of the section and open at both surfaces of the section;

wherein the front face of a first section and the back face of a second adjacent section substantially mate to form an interface;

wherein the front face of the first section and the back face of the second adjacent section include a tongue and groove wherein a tongue is mounted on one of the faces and a mating groove is defined by the other face; and wherein the interface is oriented at a non-perpendicular angle to the direction of travel over substantially the length of the interface to reduce shock loading on the individual sections by allowing gradual weight transfer from the first section to the adjacent second section.

2. The apparatus of claim 1 wherein the sections are hollow.

3. An apparatus for providing a roadway for the passage of vehicles there-over in a direction of travel, the apparatus comprising:

a plurality of sections held together by a retainer, each section comprising:

a top surface;

a bottom surface;

a front face extending between the top surface and the bottom surface from one end of the section to an opposite end thereof;

a back face extending between the top surface and the bottom surface from one end of the section to an opposite end thereof; and a plurality of upright members, each upright member extending from the top surface of the section to the bottom surface of the section;

wherein the sections are formed from hollow molded plastic;

wherein the front face of a first section and the back face of a second adjacent section substantially mate to form an interface;

wherein the front face of the first section and the back face of the second adjacent section include a tongue and groove wherein a tongue is mounted on one of the faces and a mating groove is defined by the other face;

wherein the interface is oriented at a non-perpendicular angle to the direction of travel over substantially the length of the interface to reduce shock loading on the individual sections by allowing gradual weight transfer from the first section to the adjacent second section.

4. The apparatus of claim 3 wherein at least one upright member is a hollow tube open at both surfaces of the section.

* * * * *